US012091926B2

(12) United States Patent
Sommer

(10) Patent No.: US 12,091,926 B2
(45) Date of Patent: Sep. 17, 2024

(54) ELECTRIC ACTUATOR BUS SYSTEM

(71) Applicant: OneSubsea IP UK Limited, London (GB)

(72) Inventor: Burkhard Sommer, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/255,933

(22) PCT Filed: Dec. 3, 2021

(86) PCT No.: PCT/US2021/061845
§ 371 (c)(1),
(2) Date: Jun. 5, 2023

(87) PCT Pub. No.: WO2022/120193
PCT Pub. Date: Jun. 9, 2022

(65) Prior Publication Data

US 2024/0035349 A1 Feb. 1, 2024

Related U.S. Application Data

(60) Provisional application No. 63/120,790, filed on Dec. 3, 2020.

(51) Int. Cl.
*E21B 47/001* (2012.01)
*E21B 33/035* (2006.01)
*E21B 34/04* (2006.01)

(52) U.S. Cl.
CPC ..... *E21B 33/0355* (2013.01); *E21B 34/04* (2013.01); *E21B 47/001* (2020.05)

(58) Field of Classification Search
CPC ..... E21B 33/0355; E21B 47/001; E21B 34/04
See application file for complete search history.

(56) References Cited

U.S. PATENT DOCUMENTS 9,803,471 B2 * 10/2017 Baxter ..... E21B 41/0021
2006/0064256 A1 3/2006 Appleford
(Continued)

FOREIGN PATENT DOCUMENTS

EP 3113351 B1 11/2020
WO 2014079473 A1 5/2014
WO 2015002543 A1 1/2015

OTHER PUBLICATIONS

Search Report and Written Opinion of International Patent Application No. PCT/US2021/061845 dated Mar. 29, 2022, 10 pages.
(Continued)

*Primary Examiner* — Aaron L Lembo
(74) *Attorney, Agent, or Firm* — Jeffrey D. Frantz

(57) ABSTRACT

A subsea production system may include a subsea tree that includes a first valve to control a flow of reservoir fluid through the subsea tree and a second valve to control the flow of the reservoir fluid through the subsea tree. The subsea production system may also include a bus system having multiple control modules that generate control signals to operate the first valve and the second valve. The bus system may also include a first electric bus that provides the control signals from a first control module to the first valve, a second electric bus that provides the control signals from a second control module to the second valve, and a third electric bus that provides the control signals from a third control module to the first valve and the second valve.

18 Claims, 7 Drawing Sheets

(56) References Cited

U.S. PATENT DOCUMENTS

| | | | | |
|---|---|---|---|---|
| 2013/0018514 | A1 | 1/2013 | Addala | |
| 2022/0145720 | A1 * | 5/2022 | Kleine | E21B 47/001 |

OTHER PUBLICATIONS

International Preliminary Report on Patentability of International Patent Application No. PCT/US2021/061845 dated Jun. 15, 2023, 6 pages.

* cited by examiner

ELECTRIC ACTUATOR BUS SYSTEM

CROSS-REFERENCE TO RELATED APPLICATION

This application is the National Stage Entry of International Application No. PCT/US2021/061845, filed Dec. 3, 2021, which claims priority to and the benefit of U.S. Provisional Application No. 63/120,790, entitled "ELECTRIC ACTUATOR BUS SYSTEM," filed Dec. 3, 2020, which is hereby incorporated by reference in its entirety for all purposes.

BACKGROUND

The present disclosure relates generally to a bus system for use in subsea applications, such as for controlling electric actuators.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

Hydrocarbon fluids, such as oil and natural gas, are obtained from subterranean or subsea geologic formations, referred to as reservoirs, by drilling one or more wells that penetrates the hydrocarbon-bearing geologic formation. In subsea applications, various types of infrastructure may be positioned along a sea floor and coupled by electrical lines. For example, subsea trees may monitor and control the production of a subsea well via multiple subsea valves. Traditionally, subsea production systems use hydraulic actuators controlled by pressurized hydraulic fluids for operating the subsea valves on the subsea trees. Electric actuators may provide suitable control of the subsea valves while minimizing or eliminating the need for hydraulic pumps, fluids, and tubes, but generally come at the expense of increased electrical wiring and complexity. As such, depending on the scenario, interest in electric actuators for subsea applications, such as underwater safety values (USVs), may be tempered due to the increased complexity and costs for implementing and ensuring reliable communication and supply of electric power to the electric actuators.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a subsea production system may include a subsea tree that includes a first valve to control a flow of reservoir fluid through the subsea tree and a second valve to control the flow of the reservoir fluid through the subsea tree. The subsea production system may also include a bus system having multiple control modules that generate control signals to operate the first valve and the second valve. The bus system may also include a first electric bus that provides the control signals from a first control module to the first valve, a second electric bus that provides the control signals from a second control module to the second valve, and a third electric bus that provides the control signals from a third control module to the first valve and the second valve.

In another embodiment, an electric bus system may include multiple control modules that generate control signals to operate valves, wherein each valve is operated via an electric actuator. The electric bus system may also include a first electric bus to provide the control signals from a first control module or a second control module to a first electric actuator such that the wiring of the first electric bus couples the first control module to the first electric actuator and the second control module. The electric bus system may also include a second electric bus to provide the control signals to the first electric actuator and a second electric actuator from a third control module or a fourth control module, such that the wiring of the second electric bus couples the third control module to the first electric actuator and the fourth control module.

In another embodiment, a method may include providing, via a first bus, communication between a primary subsea control module and two or more electric actuators that operate respective production flowline valves of a subsea tree. The method may also include, in response to determining a fault in the communication between the primary subsea control module and the two or more electric actuators, providing, via the first bus, the communication to the two or more electric actuators via a secondary subsea control module. Additionally, the first bus couples the primary subsea control module and the secondary subsea control module with the two or more electric actuators, such that the two or more electric actuators are daisy chained between the primary subsea control module and the secondary subsea control module.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
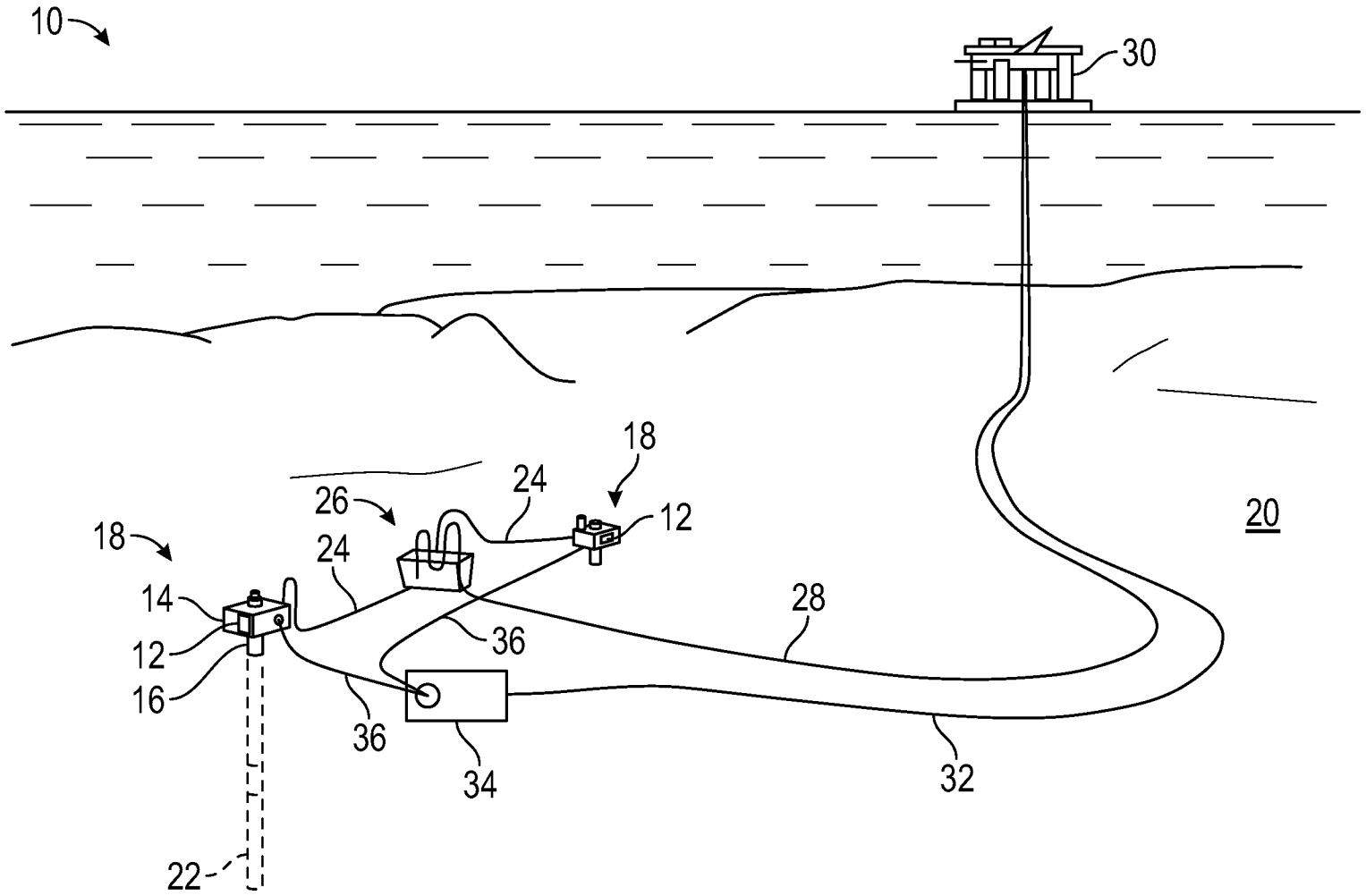
FIG. 1 is a schematic diagram of a subsea production system including a subsea tree with a looped redundant bus system, according to embodiments of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Subsea production systems extract reservoir fluids such as oil, natural gas, or other resources of interest via one or more wells that penetrate a geological formation. In some embodiments, wells may be monitored and/or controlled via subsea trees that communicate with surface controllers and monitors. The subsea trees may include multiple valves to regulate the production flow of reservoir fluids out of the reservoir, as well as injecting other fluids, such as added chemicals. Moreover, the subsea tree may use hydraulic actuators, electric actuators, or a combination of hydraulic and electric actuators to motivate the valves. Additionally, the use of electric actuators may be accomplished or facilitated via an electric bus system.

In some embodiments, to reduce the risk of undesired flow of the reservoir fluid, subsea trees may have more than one valve in the production flow. For example, a production master valve (PMV) may be followed in the production flow by a redundant production wing valve (PWV), such that closure of either valve may stop production flow. In the event of communication or power failure, redundancy of the bus system to one or more valves (e.g., the PMV and/or the PWV) in the production flow may allow the subsea tree to maintain control of either or both valves and increase the reliability of the electric actuators of the subsea tree. For example, in some embodiments, the probability that at least one valve remains controllable may be increased by utilizing a looped redundant bus system.

In some embodiments, the looped redundant bus system may utilize two separated electric buses electrically connected to respective sets of electronic devices (e.g., electric actuators) and a shared bus connected to both sets of electronic devices. As such, three electric buses are divided amongst the various electronic devices such that each electronic device is electrically connected to the control modules of the subsea tree via two buses. Furthermore, in scenarios with multiple production flow valves, each of the separated electric buses may be coupled to different production flow valves, such as the PMV and the PWV, to increase diversity and redundancy. In some embodiments, each electronic device, including both the PMV and the PWV, may be coupled to all three electric buses. It should be understood that a greater number of buses and/or components in the looped redundant bus system are contemplated. However, it is recognized that currently available electric actuators may be set up for connection to two bus systems, and cost efficiency may be increased by utilizing available electric actuators with the redundancy of diversified buses and a shared bus.

In some embodiments, the wiring of the looped redundant bus system may propagate from one electronic device (e.g., electric actuator) to another and return back to the control modules of the subsea tree after reaching each device in a looped fashion. As such, in the case of a cable line failure, control information may be fed from either direction in the loop to maintain control and redundancy. Additionally or alternatively, the wiring may include a connection from the control modules of the subsea tree to each electronic device individually. However, such connections may increase the complexity of wiring and/or increase the costs associated with the wiring. Providing the looped redundant bus system as a daisy chained loop may provide increased reliability and redundancy while reducing or minimizing wire usage.

In some embodiments, the wiring of each of the three buses may be implemented as a single cable, further reducing wiring complexity and increasing resource (e.g., cost, space, wire, etc.) efficiency. For example, a twelve-wire cable may provide four legs for each bus (e.g., power positive, power negative/neutral, bus communication positive, and bus communication negative) in a single cable. Moreover, implementing the looped redundant bus system on a single cable may further decrease manufacturing costs as well as decrease complexity associated with manufacturing, implementation, and maintenance.

Additionally, in some embodiments, each electric bus may utilize a separate control module to provide a further increase to reliability and redundancy. Furthermore, in some embodiments, each end of each looped bus may utilize a separate control module such that each bus has two control modules communicating from either end of the loop. As such, at least a portion of a particular bus will still be active even in the event of a break in the wiring of the bus or the failure of one control module of the bus.

Additionally or alternatively, in some embodiments, the buses may be bridged at each electronic device or at a single electronic device to communicate with the shared bus or opposite separated bus in the event of a failure. For example, if all of the control modules for the shared bus and one of the separated buses became inoperable, one of the electronic devices on the operable separated bus may bridge the operable bus to the shared bus or the opposite separated bus to provide control signals to the devices not originally transmitted on the operable bus. Bridging the buses may provide for an additional redundancy without additional buses or wiring.

With the foregoing in mind, FIG. 1 is a schematic view of a subsea production system 10 with a looped redundant bus system 12 integrated into a subsea tree 14, according to an embodiment of the present disclosure. The subsea tree 14 couples to a wellhead 16 to form a subsea station 18 that extracts formation fluid, such as oil and/or natural gas, from the sea floor 20 through the well 22. In some embodiments, the subsea production system 10 may include multiple subsea stations 18 that extract formation fluid from respective wells 22. After passing through the subsea tree 14, the formation fluid flows through jumper cables 24 to a pipeline manifold 26. The pipeline manifold 26 may connect to one or more flowlines 28 to enable the formation fluid to flow from the wells 22 to a surface platform 30. In some embodiments, the surface platform 30 may include a floating production, storage, and offloading (FPSO) unit or a shore-based facility. In addition to flowlines 28 that carry the formation fluid away from the wells 22, the subsea production system 10 may include lines or conduits 32 that supply fluids, as well as carry control and data lines to the subsea equipment. These conduits 32 connect to a distribution module 34, which in turn couples to the subsea stations 18 via supply lines 36.

Figure 2:
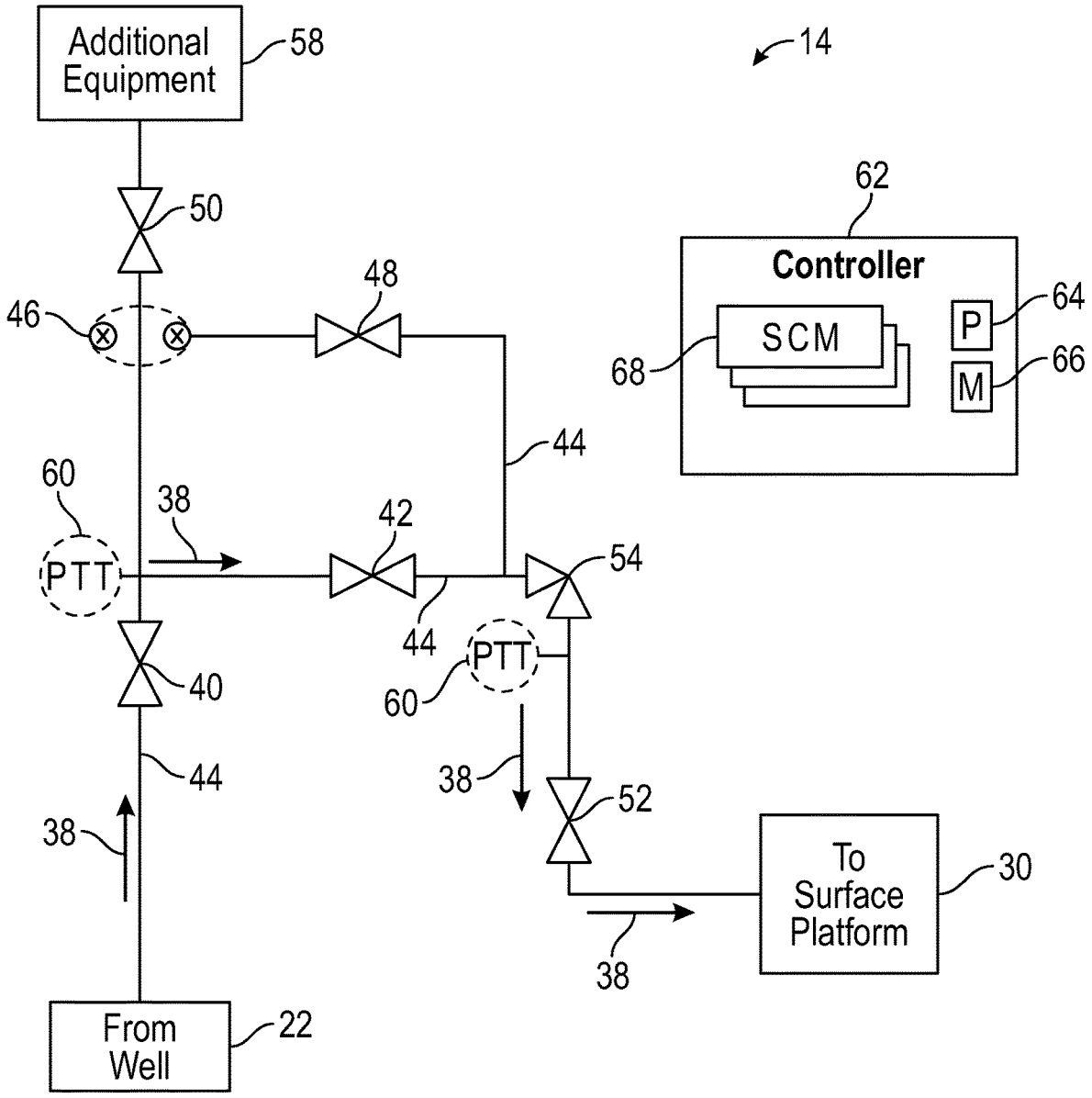
FIG. 2 is a schematic diagram of the subsea tree of FIG. 1 and a production flow from a well to a surface platform, according to embodiments of the present disclosure.

FIG. 2 is a schematic diagram of an example subsea tree 14 and the production flow 38 from a well 22 to the surface platform 30, according to an embodiment of the present disclosure. In some embodiments, the subsea tree 14 may include a production master valve (PMV) 40 and/or a production wing valve (PWV) 42 to regulate the production flow 38 through pipes 44 of the subsea tree 14. As should be appreciated, it is desirable to reliably control (e.g., shut off) the production flow 38. Moreover, redundancy in having multiple valves (e.g., the PMV 40 and the PWV 42) and/or redundancy in the communications and power to the valves may increase reliability.

In some embodiments, the pipes 44 may include an annulus path 46 surrounding the pipe 44 as an additional extraction path, input path (e.g., for chemical injection), or redundant path in case of a failure (e.g., blockage, breakage, etc.) in the pipe 44. The subsea tree 14 may also include a cross-over valve (XOV) 48 to tie the production flow 38 to the annulus path 46. Moreover, the annulus path 46 may have an annulus master valve (AMV) and/or an annulus wing valve (AWV) (not shown) as complements to the PMV 40 and/or PWV 42. Additional valves, such as a production swab valve 50, a flowline isolation valve 52, chokes 54, and/or chemical injection valves (CIVs) (not shown) may also be implemented as part of the subsea tree 14. Furthermore, the subsea tree 14 may include additional equipment 58, such as a tree cab and/or sensors 60 (e.g., pressure and/or temperature sensors), to monitor and/or assist in reservoir fluid production and/or pre-production processes.

The subsea tree 14 may also include a controller 62 having at least one processor 64 and/or at least one memory 66. In some embodiments, the controller 62 may include one or more subsea control modules (SCMs) 62 (e.g., as a bus master) for controlling electronic devices, such as electric actuators for the valves (e.g., PMV 40, PWV 42, AMV, AWV, XOV 48, the production swab valve 50, the flowline isolation valve 52, chokes 54, and/or CIVs). Moreover, in some embodiments, each SCM 68 may include their own processors 64 and memories 66. Additionally or alternatively, the controller 62 may be implemented as a centralized controller (e.g., disposed in part or entirely in the pipeline manifold 26, the distribution module 34, or other location) such that the controller 62 sends control signals to one or multiple subsea trees 14 from a centralized location in communication with the surface platform 30. As should be appreciated, the processor 64 may be implemented with any combination of general-purpose microprocessors, microcontrollers, digital signal processors (DSPs), field programmable gate arrays (FPGAs), programmable logic devices (PLDs), controllers, state machines, gated logic, discrete hardware components, dedicated hardware finite state machines, or any other suitable entities that may perform calculations or other manipulations of information. Moreover, the processor 64 may be implemented as one of multiple processors that work in conjunction with each other to perform the various functions described herein. Furthermore, the processor 64 may be operably coupled with the memory 66 to execute various algorithms stored in the memory 66 to perform the functions described herein. The memory 66 may include any suitable non-transitory medium for storing data and executable instructions, such as random-access memory, read-only memory, rewritable flash memory, hard drives, and optical discs.

Figure 3:
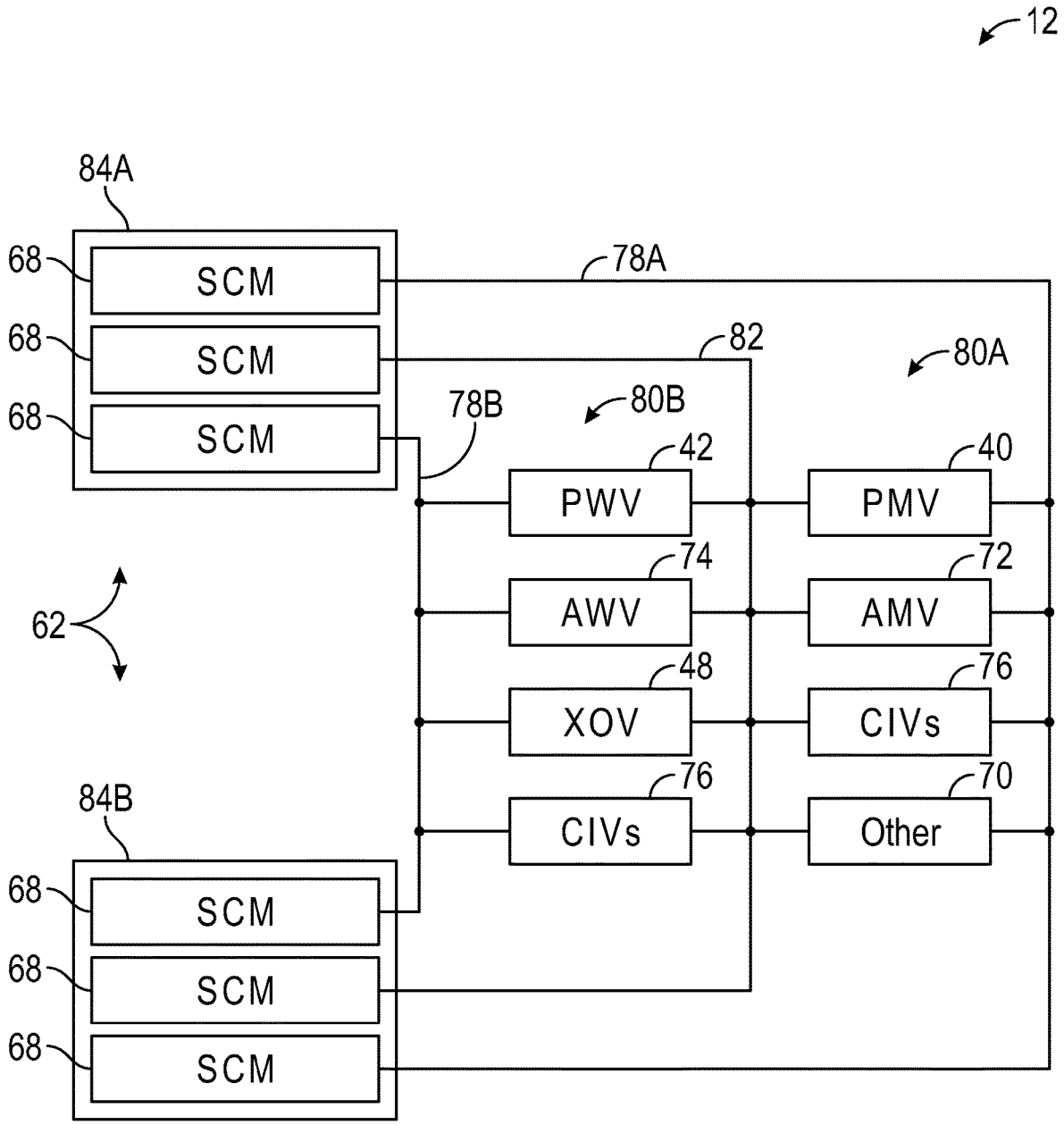
FIG. 3 is a functional diagram of the looped redundant bus system of FIG. 1, according to embodiments of the present disclosure.

In some embodiments, a looped redundant bus system 12 may be used for communications between the controller 62 (e.g., SCMs 68) and the electric actuators of the valves (e.g., PMV 40, PWV 42, AMV 72, AWV 74, XOV 48, the production swab valve 50, the flowline isolation valve 52, chokes 54, and/or CIVs) and/or other electronic devices/equipment 70, as shown in FIG. 3. The looped redundant bus system 12 may utilize two separated buses 78A and 78B (cumulatively 78) electrically connected to respective sets of electronic devices 80A and 80B (cumulatively 80) and a shared bus 82 connected to both sets of electronic devices 80. Additionally, each bus may utilize separate SCMs 68 to provide a further increase to reliability and redundancy. As such, three electric buses (e.g., separated buses 78 and shared bus 82) are divided amongst the various electronic devices 80, such that each device 80 is electrically connected to two SCMs 68 via two respective buses (e.g., shared bus 82 and either separated bus 78A or separated bus 78B). In some embodiments, each of the separated buses 78 may be coupled to different production valves (e.g., the PMV 40 and the PWV 42) and/or annulus valves (e.g., the AMV 72 and the AWV 74) to increase diversity, redundancy, and, thus, reliability. In some embodiments, each device, such as the PMV 40 and the PWV 42, may be coupled to all three electric buses (e.g., separated buses 78 and shared bus 82). However, it is recognized that currently available electric actuators may utilize connections to two bus systems, and cost/resource efficiency may be increased by utilizing available electric actuators with the redundancy of diversified buses (e.g., separated buses 78) and a shared bus.

As stated above, the buses (e.g., separated buses 78 and shared bus 82) may each connect to respective SCMs 68. Additionally, in some embodiments, the buses (e.g., separated buses 78 and shared bus 82) may loop back to the controller 62, such that control signals may be transmitted in either direction along the buses to communicate with the electronic devices 80. Additionally or alternatively, each end of a loop of a bus may utilize a separate SCM 68, such that each bus may have two SCMs 68 communicating from either end of the loop (e.g., either end of the buses). As such, at least a portion of a particular bus may still be active, even in the event of a break in the wiring of the bus or failure of an SCM 68 of the bus. For example, one SCM 68 of a particular bus may be designated as the primary SCM 68 and the other a secondary SCM 68 (e.g., as part of a dual-master or multi-master bus) to be used if the primary SCM 68 fails or the wiring fails. In some embodiments, to further increase diversity and reliability, the SCMs 68 at either ends of the loop may be housed in separate pressure housings 84A and 84B (cumulatively 84). Moreover, although discussed herein as individual control modules, the SCMs 68 may be implemented as individual circuits (e.g., sub-circuits, parallel circuits, etc.) and/or separate electronic circuit boards within a single SCM 68 or two SCMs 68 (e.g., one at either end of the loop).

Figure 4:
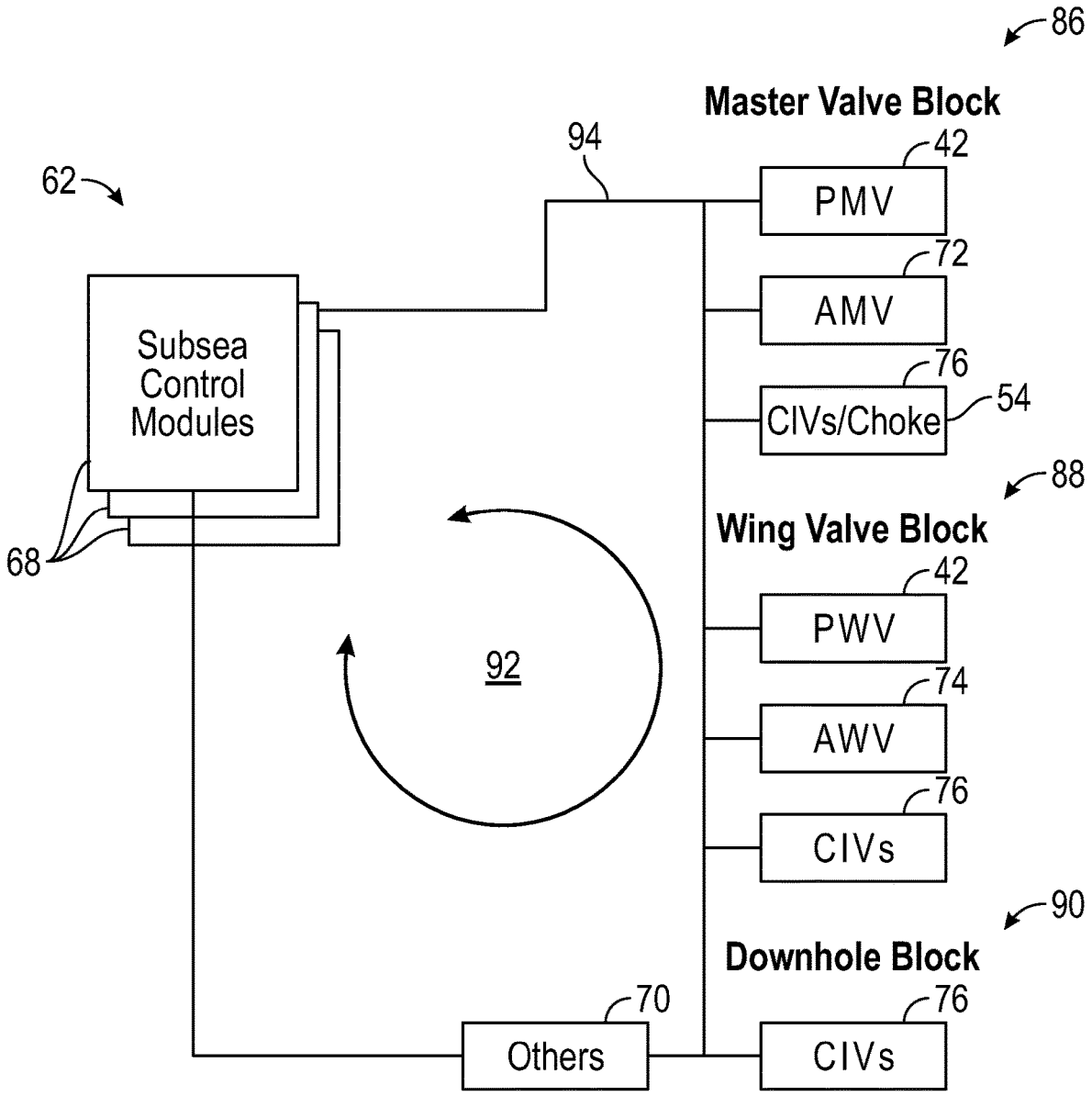
FIG. 4 is a schematic diagram of a physical layout of the looped redundant bus system of FIG. 3, according to embodiments of the present disclosure.

FIG. 4 is a schematic diagram of an example physical layout of the looped redundant bus system 12, according to an embodiment of the present disclosure. As discussed above, the buses (e.g., separated buses 78 and shared bus 82) may run from the controller 62 and from one device to the next and return to the controller 62 in a looped fashion. As such, in the case of a cable line failure, control information may be fed from either direction in the loop to maintain control and redundancy. For example, wiring for the buses may travel from the SCMs 68 to a master valve block 86 where the PMV 40 and AMV 72 are located, to a wing valve block 88 where the PWV 42 and AWV 74 are located, to a downhole block 90 where CIVs 76 for the well 22 are located, before returning to the controller 62. Control information may travel in the same direction as described, or in the opposite direction. As should be appreciated, the block locations and specific devices therein are given as examples of physical sections of the subsea tree 14 and may vary based on implementation. Additionally, other devices/equipment 70 on or off the subsea tree 14 may be connected along the loop 92. As such, the looped redundant bus system 12 may provide increased reliability with a more efficient use of resources such as wiring and reduce costs associated with manufacturing, implementation, and/or maintenance.

Additionally or alternatively, the wiring may include a connection from the control modules of the subsea tree 14 to each electronic device individually. However, such connections may increase the complexity of wiring and/or increase the costs associated with wiring. Providing the looped redundant bus system 12 as a daisy chained loop 92 may provide increased reliability and redundancy while reducing or minimizing wire usage.

In some embodiments, the wiring of each of the three buses may be implemented as a single cable 94, further reducing wiring complexity and increasing resource (e.g., cost, space, wire, etc.) efficiency. For example, a twelve-wire cable may provide four legs for each bus (e.g., power positive, power negative/neutral, bus communication positive, and bus communication negative) in the single cable 94. Moreover, implementing the looped redundant bus system 12 on a single cable 94 may further decrease manufacturing costs as well as decrease complexity associated with manufacturing, implementation, and maintenance.

Figure 5:
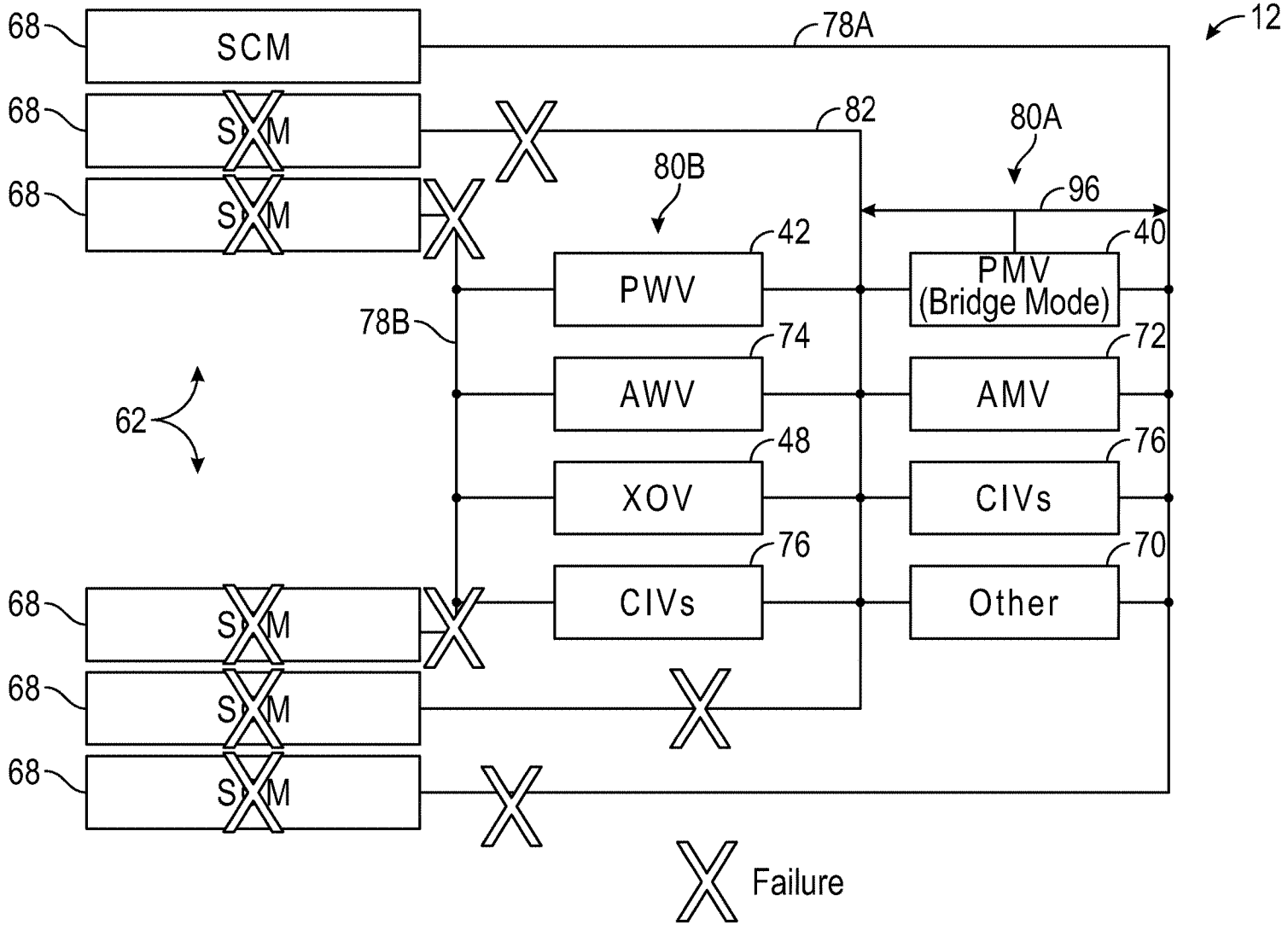
FIG. 5 is a functional diagram of the looped redundant bus system of FIG. 3 utilizing a bridge mode in response to one or more failures, according to embodiments of the present disclosure.

As stated above, it is desirable to maintain communication to and control of the electronic devices (e.g., electric actuators). Indeed, the redundancies discussed herein improve reliability by providing alternative paths for communications and power in the event of one or more failures (e.g., wire or electronics failure). In some embodiments, one of the electronic devices may create a bridge 96 between the buses to provide additional redundancy and reliability, as shown in FIG. 5. The bridge 96 may utilize circuitry of an electronic device to relay control signals from one bus to another, effectively tying the two buses together. For example, in the event of multiple failures, one separated bus 78A may be bridged at each electronic device 80 or at a single device to communicate with the shared bus 82 or the other separated bus 78B. In the depicted example, if the SCMs 68 for the shared bus 82 and one of the separated buses 78B became inoperable, one of the electronic devices (e.g., PMV 40) on the operable separated bus 78A may provide the bridge 96 to the shared bus 82 and/or or the opposite separated bus 78B (e.g., via a second bridge 96 (not shown) of the opposite set of electronic devices 80B) to provide control signals to the devices not originally on the operable bus (e.g., separated bus 78A). The bridging of the buses may provide for an additional redundancy without additional buses or wiring.

In some embodiments, the SCMs 68 and/or the electronic devices 80 may detect failures in the wiring or other electronics and switch operations to an operable bus or enable a bridge 96 accordingly. As such, in some embodiments, some or all of the electronic devices 80 may include circuitry (e.g., a processor 64 and/or memory 66) to determine failures/faults and facilitate, alone or in conjunction with the SCMs 68, switching communications to another SCM 68, another bus, or enabling a bridge 96. For example, in some embodiments, each set of electronic devices 80A and 80B may normally operate on their respective separated buses 78A and 78B. Under normal operations, this may increase available bandwidth on each separated bus 78 by having fewer devices on a particular bus. However, when a failure occurs, the controller 62 and/or electronic devices 80 may switch to communications using the SCM 68 at the other end of the loop 92, to the shared bus 82, or enable a bridge 96 to assist devices on a different separated bus 78. Furthermore, the electronic devices 80 may include default states (e.g., open or closed valve states) if it is determined that communications between the device and the controller 62 cannot be established.

Figure 6:
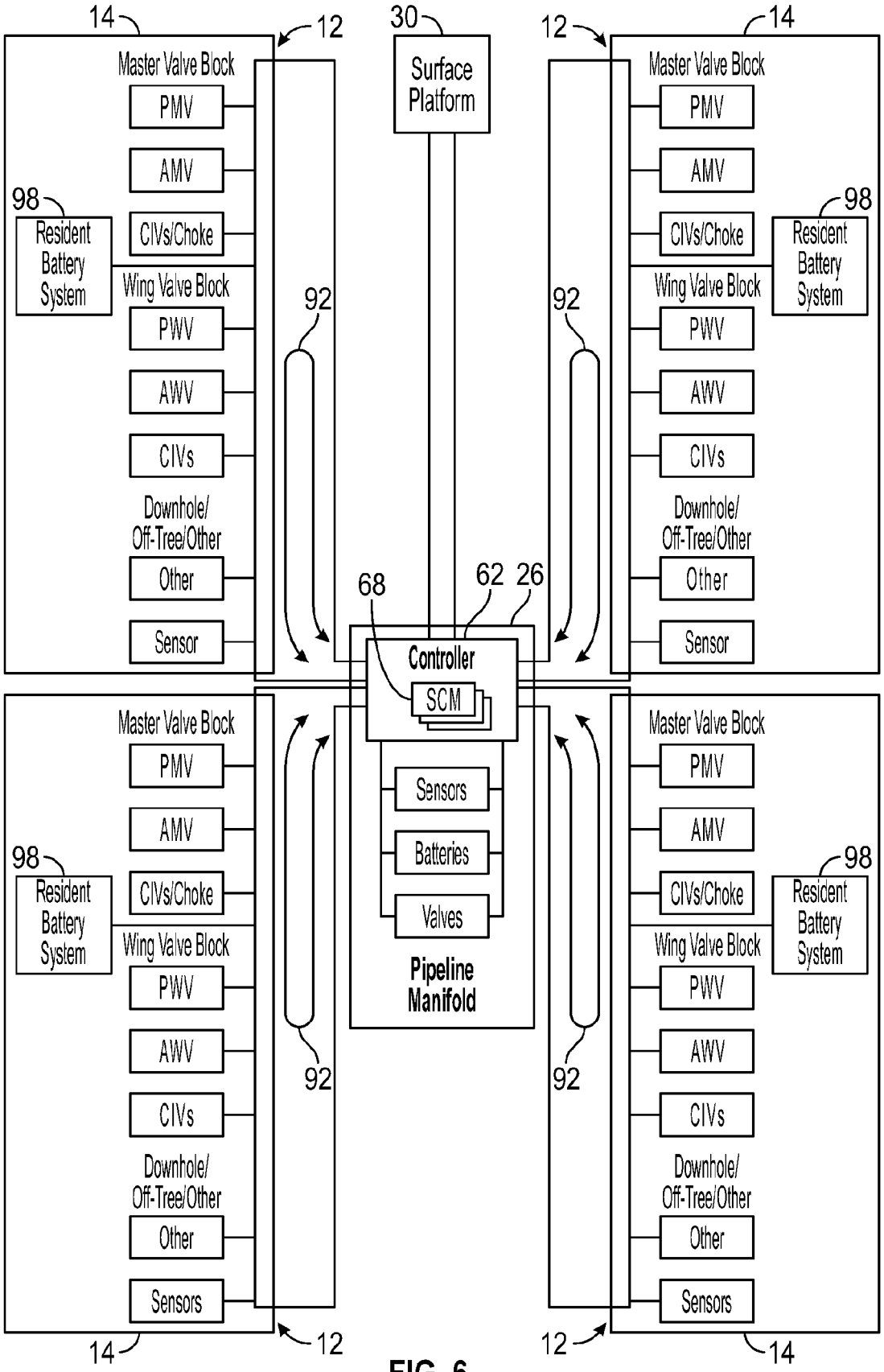
FIG. 6 is a schematic diagram of a controller utilizing multiple looped redundant bus systems to communicate with multiple subsea trees and a subsea manifold, according to embodiments of the present disclosure.

As stated above, in some embodiments, the controller 62 may be implemented at a central location (e.g., the pipeline manifold 26, the distribution module 34, etc.) and control and/or operate one or more subsea trees 14. FIG. 6 is a schematic diagram of a controller 62 utilizing multiple looped redundant bus systems 70 to communicate with multiple subsea trees 14, according to embodiments of the present disclosure. As should be appreciated, a centralized controller 62 may be implemented at any suitable location such as the pipeline manifold 26, the distribution module 34, one of the subsea trees 14, or a standalone controller hub. In some embodiments, each subsea tree 14 may include a separate power source, such as a battery system 98, coupled to the respective looped redundant bus system 12 to further increase redundancy.

Figure 7:
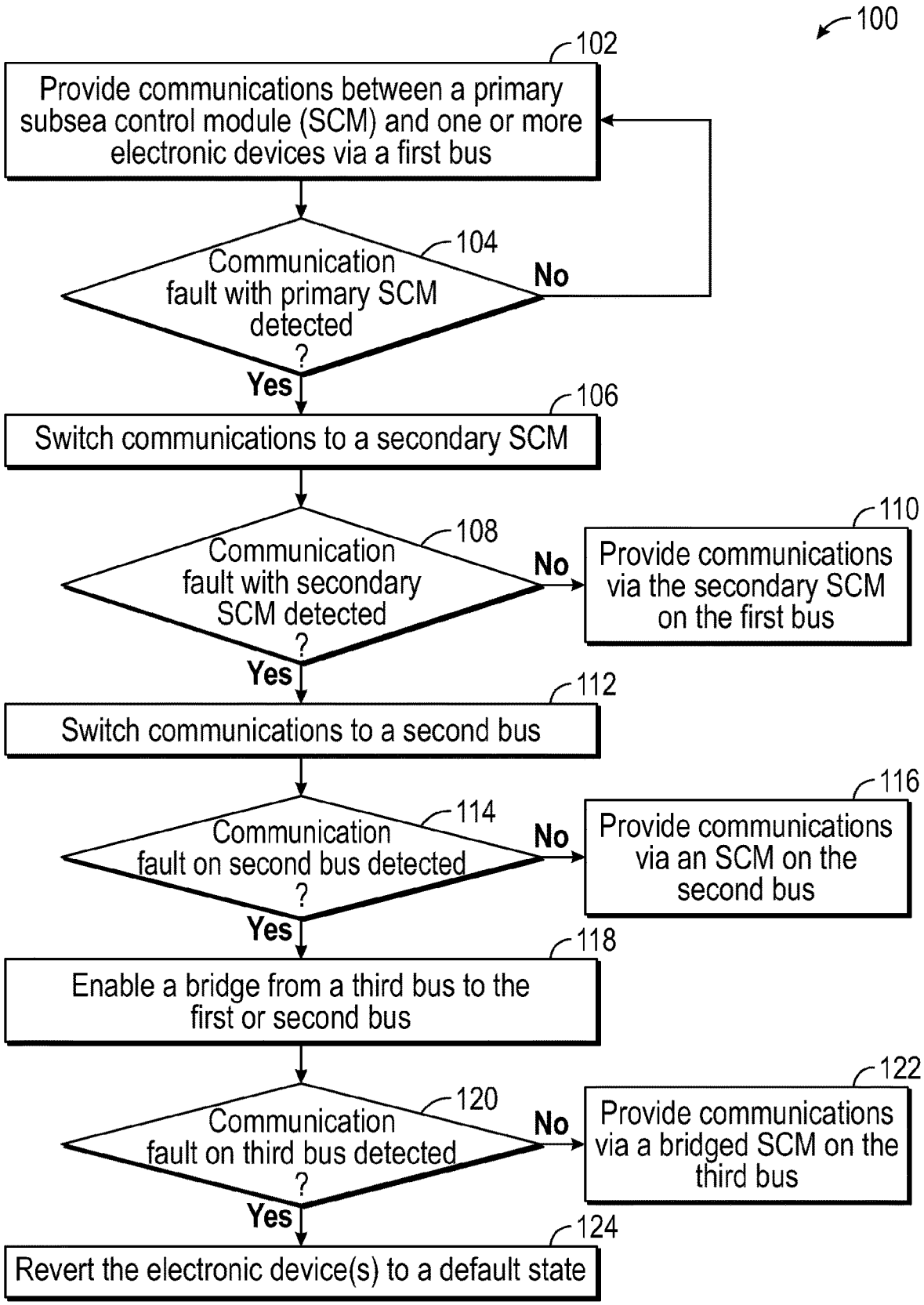
FIG. 7 is a flowchart of an example process utilizing the looped redundant bus system of FIG. 3, according to embodiments of the present disclosure.

FIG. 7 is a flowchart of an example process 100 utilizing the looped redundant bus system 12, according to embodiments of the present disclosure. The looped redundant bus system 12 may provide communications between a primary SCM 68 and one or more electronic devices 80 (e.g., electric actuators of valves, sensors 60, or other equipment 70) via a first bus (e.g., separated bus 78 or shared bus 82) (process block 102). In some embodiments, the controller 62 (e.g., via the primary or secondary SCM 68) and/or the electronic devices 80 may monitor for and detect a fault in the communications with the primary SCM 68 (decision block 104). In response to detecting the communication fault, communications may be switched to a secondary SCM 68 on the first bus (process block 106). If no communication fault is detected with the secondary SCM (decision block 108), the communications may be provided via the secondary SCM 68 on the first bus (process block 110). However, if a communication fault is detected with the secondary SCM 68 (decision block 108), communications may be switched to a second bus (process block 112). If no communication fault is detected on the second bus (decision block 114), the communications may be provided via an SCM 68 on the second bus (process block 116). As should be appreciated, the SCM 68 of the second bus may be either a primary SCM 68 of the second bus or a secondary SCM 68 of the second bus. However, if a communication fault is detected on the second bus (decision block 114), for example a fault with communicating with either the primary SCM 68 of the second bus or a secondary SCM 68 of the second bus, a bridge from a third bus to the first or second bus may be enabled (process block 118). If no communications fault is detected on the third bus (decision block 120), the communications may be provided via a bridged SCM 68 on the third bus (process block 122). Furthermore, if a communication fault on the third bus is determined (decision block 120), for example a communication failure between the electronic device(s) and the SCMs 68 of each bus, the electronic device(s) may revert to a default state (process block 124), such as an open or closed valve state.

The technical effects of the systems and methods described herein include a subsea tree with a looped redundant bus system that provides increased reliability with a more efficient use of resources such as wiring and reduces costs associated with manufacturing, implementation, and/or maintenance. Furthermore, although the above referenced flowchart is shown in a given order, in certain embodiments, process blocks may be reordered, altered, deleted, and/or occur simultaneously. Additionally, the referenced flowchart is given as an illustrative tool and further decision and process blocks may also be added depending on implementation.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A subsea production system, comprising:

a subsea tree comprising:

a first valve configured to control a flow of reservoir fluid through the subsea tree; and a second valve configured to control the flow of the reservoir fluid through the subsea tree; and a bus system comprising:

a plurality of control modules configured to generate control signals to operate the first valve and the second valve;

a first electric bus configured to provide the control signals from a first control module of the plurality of control modules to the first valve;

a second electric bus configured to provide the control signals from a second control module of the plurality of control modules to the second valve;

a third electric bus configured to provide the control signals from a third control module of the plurality of control modules to the first valve and the second valve; and a single cable comprising the first electric bus, the second electric bus, and the third electric bus, wherein the single cable couples the plurality of control modules to the first valve, from the first valve to the second valve, and from the second valve back to the plurality of control modules in a daisy chain.

2. The subsea production system of claim 1, wherein the first electric bus is configured to provide the control signals from a fourth control module of the plurality of control modules to the first valve.

3. The subsea production system of claim 2, wherein the first control module is a primary control module, and wherein the first electric bus is configured to provide the control signals from the fourth control module to the first valve based on a loss of communication between the primary control module and the first valve.

4. The subsea production system of claim 2, wherein the first electric bus comprises wiring from the first control module to the first valve, from the first valve to a third valve, and from the third valve to the fourth control module.

5. The subsea production system of claim 1, wherein the second control module is not configured to operate the first valve.

6. The subsea production system of claim 5, wherein the first valve comprises a production master valve of the subsea tree and the second valve comprises a production wing valve of the subsea tree.

7. The subsea production system of claim 1, further comprising:

second subsea tree comprising one or more valves;

a second bus system comprising a second plurality of control modules; and a central controller comprising the plurality of control modules and the second plurality of control modules.

8. The subsea production system of claim 1, wherein the first valve comprises an electric actuator configured to operate the first valve based on the control signals.

9. The subsea production system of claim 1, wherein, in response to a fault condition, the first valve is configured to bridge the first electric bus and the third electric bus to couple the second valve to the first control module via the third electric bus and the first electric bus.

10. An electric bus system comprising:

a plurality of control modules configured to generate control signals to operate a plurality of valves, wherein each valve of the plurality of valves is operated via an electric actuator;

a first electric bus configured to provide the control signals from a first control module or a second control module of the plurality of control modules to a first electric actuator, wherein first wiring of the first electric bus couples the first control module to the first electric actuator and the second control module; and a second electric bus configured to provide the control signals to the first electric actuator and a second electric actuator from a third control module or a fourth control module of the plurality of control modules, wherein second wiring of the second electric bus couples the third control module to the first electric actuator and the fourth control module.

11. The electric bus system of claim 10, further comprising a third electric bus configured to provide the control signals to the second electric actuator from a fifth control module of the plurality of control modules.

12. The electric bus system of claim 10, wherein the first electric actuator is configured to bridge the first electric bus and the second electric bus.

13. The electric bus system of claim 10, wherein a single cable comprises the first wiring and the second wiring.

14. The electric bus system of claim 10, wherein the second electric actuator does not communicate with the first control module via the first electric bus.

15. A method comprising:

providing, via a first bus, communication between a primary subsea control module and two or more electric actuators configured to operate respective production flowline valves of a subsea tree; and in response to determining a fault in the communication between the primary subsea control module and the two or more electric actuators, providing, via the first bus, the communication to the two or more electric actuators via a secondary subsea control module, wherein the first bus is configured to couple the primary subsea control module and the secondary subsea control module with the two or more electric actuators, and wherein the two or more electric actuators are daisy chained between the primary subsea control module and the secondary subsea control module.

16. The method of claim 15, further comprising, in response to determining a second fault in the communication to the two or more electric actuators via the secondary subsea control module, providing, via a second bus, the communication to the two or more electric actuators via a third subsea control module.

17. The method of claim 16, further comprising:

in response to determining a third fault in the communication to the two or more electric actuators via the third subsea control module, enabling, via a separate electric actuator, a bridge from a third bus to the second bus; and providing, via the third bus and the second bus, the communication to the two or more electric actuators via a fourth subsea control module.

18. The method of claim 15, further comprising, in response to an electric actuator of the two or more electric actuators determining a loss of the communication, actuating the electric actuator to a default state.

* * * * *